US006706903B1

(12) United States Patent
Hendree et al.

(10) Patent No.: US 6,706,903 B1
(45) Date of Patent: Mar. 16, 2004

(54) PROCESS FOR SEPARATING SATURATED FATTY ACIDS FROM FATTY ACID MIXTURES

(75) Inventors: Guy Hendree, Memphis, TN (US); Shannon Martin, Cordova, TN (US); Thomas E. Breuer, Cordova, TN (US); Kyle Walker, Germantown, TN (US)

(73) Assignee: Crompton Corporation, Middlebury, CT (US)

( * ) Notice: Subject to any disclaimer, the term of this patent is extended or adjusted under 35 U.S.C. 154(b) by 0 days.

(21) Appl. No.: 10/267,060

(22) Filed: Oct. 7, 2002

(51) Int. Cl.[7] ..... C11B 51/00
(52) U.S. Cl. ..... 554/211
(58) Field of Search ..... 554/211

(56) References Cited

U.S. PATENT DOCUMENTS

| | | | | |
|---|---|---|---|---|
| 5,514,405 | A | 5/1996 | Yokomichi et al. | 426/604 |
| 5,674,475 | A | 10/1997 | Dahms et al. | 424/59 |
| 5,945,318 | A | 8/1999 | Breivik et al. | 435/134 |
| 5,952,518 | A | 9/1999 | Sugiura et al. | 554/208 |

*Primary Examiner*—Deborah D. Carr
(74) *Attorney, Agent, or Firm*—Michael P. Dilworth

(57) ABSTRACT

A process for removing saturated fatty acids from a primarily unsaturated fatty acid mixture is disclosed wherein the process comprises fractionally distilling off saturated $C_{16}$ and other minor fatty acid components in the mixture to a level less than or equal to 4% by weight, adding a lower polyglycerol ester as a crystallization aid, then cooling and fractionally crystallizing out remaining saturated fatty acids to yield a product comprising less than 3.3% saturated fatty acids by weight.

16 Claims, No Drawings

PROCESS FOR SEPARATING SATURATED FATTY ACIDS FROM FATTY ACID MIXTURES

BACKGROUND OF THE INVENTION

1. Field of the Invention

The present invention relates to a process for separating saturated fatty acids from fatty acid mixtures. More particularly, the present invention relates to a process for preparing unsaturated fatty acids having reduced levels of saturated fatty acid components.

2. Description of Related Art

Fatty acids are widely used as intermediates for foods, such as monoglycerides and diglycerides, and as additives and intermediates for a variety of industrial products. Such fatty acids are generally produced by hydrolyzing vegetable oils, such as rapeseed oil or soybean oil, or animal fats, such as beef tallow, under high pressure.

However, the fatty acids produced by this method alone contain saturated fatty acids derived from the fats and oils used as the feedstock. Thus it has been found that these saturated fatty acids adversely influence some final products such as monoglycerides, diglycerides, triglycerides, and other esters. For example, when a fatty acid mixture containing saturated fatty acids is used as a feedstock to produce diglycerides, the diglycerides may contain solid crystallized particles or are in a semi-solid state at room temperature and, in cold situations may completely crystallize (solidify) to lose their flowability. These diglycerides thus have poor appearance qualities and other problems, such as difficulty in removal from containers.

U.S. Pat. No. 5,514,405 discloses a frying oil or fat composition employable for producing fried foodstuffs having satisfactory crisp and well acceptable moderate oily or fatty taste comprising not more than 4.0 weight % of an emulsifier dissolved in an oil or a fat. The emulsifier should be chosen to make the oil or fat composition show an interfacial tension of not more than 7 mN/m at 80° C., 3 sec. after the time when the oil or fat composition is mixed with water to form an interface between a phase of the oil or fat and an aqueous phase. A frying oil or fat composition containing a sugar fatty acid ester of a specifically selected composition, or a combination of a sugar fatty acid ester and a polyglycerol fatty acid ester and/or a diglyceride is said to be also employable for the same purpose.

U.S. Pat. No. 5,674,475 discloses an emulsifier composition that is a mixture of polyglycerol fatty acid ester ($n \geqq 4$) and the lactylate of a fatty acid ($C \geqq 8$) or its salt and is used to manufacture a wide range of different O/W emulsions, e.g. sunscreen emulsions for cosmetics. The polyglycerol fatty acid ester preferably has an HLB value $\leqq 8$. The emulsifier composition can additionally contain a lipophilic emulsifier.

U.S. Pat. No. 5,945,318 discloses a process for treating an oil composition containing saturated and unsaturated fatty acids in the form of triglycerides, with at least some of the unsaturated fatty acids being polyunsaturated, in order to obtain a refined product with a higher concentration of the polyunsaturated fatty acids.

U.S. Pat. No. 5,952,518 discloses a method for efficiently removing saturated fatty acids from a fatty acid mixture by adding an emulsifying agent to a feedstock fatty acid mixture, mixing and then cooling the mixture, and removing the crystallized portion by dry fractionation, and the use of the obtained reduced saturated fatty acid level mixture to produce fatty acid esters resistant to crystallization at low temperatures.

The disclosures of the foregoing are incorporated herein by reference in their entirety.

SUMMARY OF THE INVENTION

An object of the present invention is to provide a method for efficiently removing saturated fatty acids from a fatty acid mixture obtained from a selected feedstock.

A further object of the present invention is to provide a method for the production of fatty acid esters that resist crystallization or solidification even at low temperatures.

These and other objects are provided by the present invention, which is directed to a process for removing saturated fatty acids from a primarily unsaturated fatty acid mixture comprising fractional distillation to remove $C_{16}$ and other minor fatty acid components in the mixture to a level less than or equal to 4% by weight, adding a lower polyglycerol ester as a crystallization aid, then cooling and fractionally crystallizing out remaining saturated fatty acids to yield a product comprising less than 3.3% saturated fatty acids by weight.

In another aspect, the present invention is directed to a product comprising at least one unsaturated fatty acid prepared by a process comprising fractional distillation to remove $C_{16}$ and other minor fatty acid components from a primarily unsaturated fatty acid mixture to a level less than or equal to 4% by weight, adding a lower polyglycerol ester as a crystallization aid, then cooling and fractionally crystallizing out remaining saturated fatty acids to yield said product comprising less than 3.3% saturated fatty acids by weight.

DESCRIPTION OF THE PREFERRED EMBODIMENTS

The present invention is directed to a process for making unsaturated fatty acids having lower levels of saturated fatty acids present than have been obtainable by other methods heretofore known in the art. More specifically, the present invention is directed to a process for making such a product by fractionally distilling off most of the palmitic ($C_{16}$) and lower fatty acids from soya or other fatty acids, then fractionally crystallizing off the stearic ($C_{18}$) saturated fatty acids along with some of the remaining palmitic acid, to yield an unsaturated fatty acid with less than 3.3%, preferably less than 3%, more preferably less than 2%, total saturated fatty acids remaining, using a lower polyglycerol ester, e.g., triglycerol monostearate, as a crystallization aid in that step. While it is possible to fractionally crystallize either saturated fats or fatty acids out by known processes, these lower polyglycerol ester are less expensive than those used in the past and are unique in that they function as crystallization aids after the distillation step, but not before. Further, by the process of the present invention, fatty acid levels below 2% can be achieved.

The present method is especially effective when used for diminishing saturated fatty acids from a fatty acid mixture derived from vegetable oils, such as rapeseed oil or soybean oil, wherein the feedstock fatty acid mixture can be distilled to have a stearic acid content of 10% by weight or lower, preferably 5% by weight or lower. Partial glycerides may be present therein.

The fatty acid mixture to be used as the feedstock in the present invention is produced from vegetable oils, such as rapeseed oil or soybean oil, or animal fats, through conventional processes, such as hydrolysis by steam splitting or through hydrolysis using a lipase as the catalyst. In the present invention, it is preferred to use fatty acid mixtures in which the content of saturated fatty acids, such as palmitic acid and stearic acid, is fundamentally low, such as those derived from vegetable oils.

The crystallization aid used in the present method is a lower polyglycerol/fatty acid ester. A combination of two or more such esters may be used, if desired. As employed herein, the term "lower polyglycerol" means diglycerol, triglycerol, tetraglycerol, pentaglycerol, and hexaglycerol. In such materials, up to about 10% by weight of heptaglycerol may, if desired, be present along with one or more of these lower polyglycerols. Preferably, however, heptaglycerol or higher polyglycerols will be absent.

Any of the commonly available fatty acids can be used to esterify the polyglycerol, e.g., saturated fatty acids, such as butyric, lauric, palmitic, or stearic acids, or unsaturated fatty acids, such as oleic, linoleic, or linolenic acids. If desired, all of the hydroxyl groups of the polyglycerol can be esterified with one or more of such, or other, fatty acids, but more typically less than all, and preferably about one to three of such hydroxyl groups will be esterified. In the practice of the present invention, triglycerol esters are preferred; triglycerol monoesters are especially preferred. Triglycerol monostearate, which is commercially available, is particularly preferred.

The crystallization aid is preferably added in an amount of about 0.001 to about 1% by weight, more preferably about 0.05 to about 0.5% by weight, based on the feedstock fatty acid mixture.

In the present invention, the level of saturated fatty acids from a feedstock fatty acid mixture is reduced by distilling the mixture, adding a crystallization aid to the feedstock fatty acid mixture, mixing and then cooling the mixture, and removing the crystallized portion. The crystallization aid is mixed and dissolved, preferably at 30° C. or higher, so as to be completely dissolved in the fatty acid mixture.

The cooling time and cooling temperature are not limited, and may be selected according to the composition of the feedstock fatty acid composition. Although there will be variance depending on the feedstock amount, cooling capacity, and the like, cooling to 0° C. for 3 to 30 hours, preferably about 15 to 25 hours, is usually necessary for certain feedstocks, such as soybean fatty acids. The cooling may be performed using any conventional process, including either batch, continuous, or semi-continuous processes. Filtration, centrifugation, sedimentation/separation, or the like can also be used as a method for crystal separation. Similarly, these processes can be batch, continuous, or semi-continuous processes.

The process of the present invention preferably starts with a standard refined and bleached soybean oil. This oil is hydrolyzed or split to yield glycerine and fatty acids, including some saturated fatty acids, e.g., about 10% $C_{16}$ (palmitic) and about 4% $C_{18}$ (stearic). It is commercially desirable to provide a product having a total of these saturates below about 3.3%.

The present invention employs a unique approach, i.e., distilling off much of the palmitic acid, then crystallizing out enough of the stearic acid, along with some of the remaining palmitic, to achieve the desired level.

According to the present invention, a lower polyglycerol ester of a simpler nature than that employed previously can be used as the crystallization aid because the fatty acids have been distilled prior to the crystallization. In processes known in the art, lower polyglycerol esters could not be used because they do not work with whole soya, i.e., unfractionated, fatty acids. According to the present invention, however, soya fatty acids are employed as in the past, but most of the palmitic and other minor fatty acid components are first distilled off, then the crystallization aid, preferably commercially available triglycerol monostearate, is added to the distilled stock, which is then chilled causing stearic acid and some other remaining saturated acids to crystallize out, and separated from the liquid fatty acids.

The product of the process of the present invention is useful for making a dialkyl glygeride (DAG) oil. Such DAG oils have been sold in Japan for several years, and have captured a large share of the cooking/salad oil market because they are not processed and stored by the body as a fat, but rather are burned as a carbohydrate type material. This assists in weight loss for the consumer, as well as in providing other health benefits.

The advantages and the important features of the present invention will be more apparent from the following example.

EXAMPLE

Refined, bleached soya triglycerides are received into the plant by railcar or tank truck and are stored at temperatures between 200° and 250° F. (93° and 121° C.). From storage, the triglycerides are fed to a pressure splitter. In the splitter, the triglycerides will react, or split, with water under a pressure of up to 800 psig and a temperature of up to 500° F. (260° C.) to form fatty acids and glycerin. The glycerin is separated from the fatty acids.

After splitting, the soya fatty acid, or split soya, is fed into a vacuum distillation unit. Typically, the unit operates with a bottoms temperature of approximately 500° F. (260° C.) and a top of column pressure of 5 mm Hg absolute. The column distills material taking a residue cut of 18% and a light ends cut of 12%. The distilled stock produced will typically have a fatty acid composition of approximately 2.5% palmitic and 5.0% stearic acids by weight.

The distilled stock is blended with a crystallization aid, i.e., a lower polyglycerol ester, such as triglycerol monostearate, at 3,000–3,500 ppm. The new solution is cooled in a crystallizer using chilled water with a temperature difference of 20–50° F. (11–28° C.) between the cooling media and the fatty acid. Once the crystallizer has reached the crystallization point (typically 65–75° F., i.e., 18–24° C.), the temperature difference between the cooling media and fatty acid is reduced to 15–20° F. (8–11° C.). Large crystals are formed in this method that are easily separated. The chilling continues until a final temperature in the range of 18 to 25° F. (−8–to −4° C.) is reached. The chilled distilled stock is passed through a disc-stack centrifuge. The solid crystals are separated from the distilled stock product and ejected from the centrifuge to produce a material called soya cake. The final product is a clear liquid. The yield of the desired product for the process is approximately 45%, based on the soybean oil raw material.

In view of the many changes and modifications that can be made without departing from principles covered by the invention, reference should be made to the appended claims for an understanding of the scope of the protection to be afforded the invention.

What is claimed is:

1. A process for removing saturated fatty acids from a primarily unsaturated fatty acid mixture comprising fractionally distilling off saturated $C_{16}$ and other minor fatty acid components in the mixture to a level less than or equal to 4% by weight, adding a lower polyglycerol ester as a crystallization aid, then cooling and fractionally crystallizing out remaining saturated fatty acids to yield a product comprising less than 3.3% saturated fatty acids by weight.

2. The process of claim 1 wherein the primarily unsaturated fatty acid mixture is a soya fatty acid mixture.

3. The process of claim 1 wherein the lower polyglycerol ester is a triglycerol ester.

4. The process of claim 3 wherein the triglycerol ester is a triglycerol monoester.

5. The process of claim 4 wherein the triglycerol monoester is triglycerol monostearate.

6. The process of claim 1 wherein the product comprises less than 3% saturated fatty acids by weight.

7. The process of claim 1 wherein the product comprises less than 2% saturated fatty acids by weight.

8. The process of claim 1 wherein the lower polyglycerol ester is employed at a level in the range of from about 0.001 to about 1% by weight, based on the weight of the fatty acid mixture.

9. A product comprising at least one unsaturated fatty acid prepared by a process comprising fractionally distilling off $C_{16}$ and shorter saturated fatty acids from a primarily unsaturated fatty acid mixture to a level less than or equal to 4% by weight, adding a lower polyglycerol ester as a crystallization aid, then cooling and fractionally crystallizing out remaining saturated fatty acids to yield said product comprising less than 3.3% saturated fatty acids by weight.

10. The product of claim 9 wherein the primarily unsaturated fatty acid mixture is a soya fatty acid mixture.

11. The product of claim 9 wherein the lower polyglycerol ester is a triglycerol ester.

12. The product of claim 11 wherein the triglycerol ester is a triglycerol monoester.

13. The product of claim 12 wherein the triglycerol monoester is triglycerol monostearate.

14. The product of claim 9 wherein the product comprises less than 3% saturated fatty acids by weight.

15. The product of claim 9 wherein the product comprises less than 2% saturated fatty acids by weight.

16. The product of claim 9 wherein the lower polyglycerol ester is employed at a level in the range of from about 0.001 to about 1% by weight, based on the weight of the fatty acid mixture.

* * * * *